US010611541B2

(12) United States Patent
Dieringer et al.

(10) Patent No.: US 10,611,541 B2
(45) Date of Patent: Apr. 7, 2020

(54) FLEXIBLE DISPENSER FOR COMPACT STACK OF FOLDED TISSUES

(71) Applicant: Kimberly-Clark Worldwide, Inc., Neenah, WI (US)

(72) Inventors: Jessica Annette Ives Dieringer, Menasha, WI (US); Sara Jane Wille Stabelfeldt, Appleton, WI (US); Julie Ann Paveletzke, Appleton, WI (US); Jordyn Kaylee Somerville, Appleton, WI (US); Gacia Coronado, Appleton, WI (US); Christopher Peter Olson, Neenah, WI (US); Andrew Peter Bakken, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/060,394

(22) PCT Filed: Apr. 29, 2016

(86) PCT No.: PCT/US2016/030047

§ 371 (c)(1),
(2) Date: Jun. 7, 2018

(87) PCT Pub. No.: WO2017/188979

PCT Pub. Date: Nov. 2, 2017

(65) Prior Publication Data

US 2018/0362236 A1 Dec. 20, 2018

(51) Int. Cl.
*B65D 83/08* (2006.01)
*B65H 45/24* (2006.01)
(Continued)

(52) U.S. Cl.
CPC ..... *B65D 75/5877* (2013.01); *A47K 10/32* (2013.01); *B65D 83/0805* (2013.01);
(Continued)

(58) Field of Classification Search
None
See application file for complete search history.

(56) References Cited

U.S. PATENT DOCUMENTS

D173,328 S 10/1954 Stoll
3,121,510 A 2/1964 Holzwarth
(Continued)

FOREIGN PATENT DOCUMENTS

EP 2336046 A1 6/2011
GB 868088 A 5/1961
(Continued)

*Primary Examiner* — Gene O Crawford
*Assistant Examiner* — Ayodeji T Ojofeitimi
(74) *Attorney, Agent, or Firm* — Kimberly-Clark Worldwide, Inc.

(57) ABSTRACT

The invention provides a sheet material dispenser and more particularly a dispenser for storing and dispensing a compact stack of folded tissue products. The compact stack of folded tissues may be secured by the tension of a pair of opposed side panels having a generally elliptical shape. The elliptically shaped side panels result in a rigid, resilient framework such that the dispenser has sufficient resiliency to maintain its shape even after a portion of the folded tissue products have been dispensed.

18 Claims, 5 Drawing Sheets

(51) Int. Cl.
*B65D 75/58* (2006.01)
*A47K 10/32* (2006.01)
*A47K 10/42* (2006.01)

(52) U.S. Cl.
CPC ..... *B65H 45/24* (2013.01); *A47K 2010/3266* (2013.01); *A47K 2010/428* (2013.01); *B65D 2575/586* (2013.01); *B65H 2701/18272* (2013.01)

(56) References Cited

U.S. PATENT DOCUMENTS

| | | | | |
|---|---|---|---|---|
| 4,536,889 | A | 8/1985 | Taylor | |
| 4,997,105 | A | 3/1991 | Fischer | |
| 5,080,254 | A | 1/1992 | Feer | |
| 5,127,545 | A | 7/1992 | French | |
| 5,361,902 | A | 11/1994 | Abidin | |
| 5,363,985 | A | 11/1994 | Cornell | |
| D365,981 | S | 1/1996 | Sullivan | |
| 5,520,308 | A | 5/1996 | Berg | |
| D394,605 | S | 5/1998 | Skiba | |
| D414,407 | S | 9/1999 | Simburger | |
| 5,964,351 | A | 10/1999 | Zander | |
| 6,012,572 | A | 1/2000 | Heathcock | |
| 6,227,441 | B1 | 5/2001 | Sagel | |
| 6,550,635 | B1 * | 4/2003 | King | A45F 5/02 221/185 |
| D496,263 | S | 9/2004 | Chen | |
| D623,076 | S | 9/2010 | Westemeyer | |
| 7,922,036 | B2 | 4/2011 | Bendor | |
| D643,745 | S | 8/2011 | Hartley | |
| 8,038,349 | B2 | 10/2011 | Andersson | |
| D692,318 | S | 10/2013 | Brewster | |
| 8,640,870 | B2 | 2/2014 | Ruman | |
| 8,689,528 | B1 | 4/2014 | Gaspari | |
| 8,695,793 | B2 | 4/2014 | Saggar | |
| D739,191 | S | 9/2015 | Rana | |
| D763,704 | S | 8/2016 | Latshaw | |
| D764,933 | S | 8/2016 | Latshaw | |
| 2002/0084279 | A1 | 7/2002 | Lickstein | |
| 2002/0139705 | A1 | 10/2002 | Hajianpour | |
| 2003/0116581 | A1 * | 6/2003 | Schmidt | A47K 10/421 221/49 |
| 2005/0205593 | A1 | 9/2005 | Young | |
| 2006/0151515 | A1 * | 7/2006 | Hood | B65D 83/0805 221/29 |
| 2007/0012589 | A1 | 1/2007 | Cassoni | |
| 2007/0034639 | A1 * | 2/2007 | Zeiron | A47K 10/427 221/47 |
| 2007/0062968 | A1 * | 3/2007 | Mark | B65D 83/0894 221/48 |
| 2008/0041755 | A1 | 2/2008 | Noschang | |
| 2008/0190974 | A1 | 8/2008 | Finn | |
| 2010/0001016 | A1 | 1/2010 | Savage | |
| 2011/0088132 | A1 | 4/2011 | McNamee-Sollars | |
| 2011/0192861 | A1 | 8/2011 | Bates | |
| 2012/0273513 | A1 | 11/2012 | Stephens | |
| 2012/0297562 | A1 | 11/2012 | Bhojwani | |
| 2013/0180985 | A1 | 7/2013 | Damaghi | |
| 2013/0292431 | A1 | 11/2013 | Christian | |
| 2014/0001072 | A1 | 1/2014 | Christoffel | |
| 2014/0001196 | A1 * | 1/2014 | Bushman | B65D 75/5833 221/45 |
| 2015/0008238 | A1 | 1/2015 | Yamada | |
| 2015/0216378 | A1 | 8/2015 | Fulscher | |

FOREIGN PATENT DOCUMENTS

| | | | |
|---|---|---|---|
| JP | 5156486 | A2 | 6/1993 |
| JP | 2003002339 | A2 | 1/2003 |
| KR | 101290109 | B1 | 7/2013 |
| WO | 05051261 | A1 | 6/2005 |

* cited by examiner

FLEXIBLE DISPENSER FOR COMPACT STACK OF FOLDED TISSUES

BACKGROUND OF THE DISCLOSURE

There are a variety of storing and dispensing containers in the market, particularly those for storing and dispensing folded tissue sheets and more particularly sheets of wipes such as tissues or pre-moistened wipes, collectively referred to as tissue products. Typically, tissue products are folded and stacked in a container. For example, containers of tissue products have been available wherein each of the tissue products stacked in the container has been arranged in a folded configuration such as a C-folded, Z-folded or quarter-folded configuration as are well known to those skilled in the art. Sometimes each folded tissue product is interfolded with the folded tissue product immediately above and below it in the stack. In an alternative configuration, the folded tissue products have been placed in a container in the form of a continuous web of material that includes perforations adapted to allow for separation of individual tissue products from the web upon the application of a pulling force.

Many containers for storing and dispensing sheets of wipes such as tissues or pre-moistened wipes tissue products have been developed to allow consumers to conveniently carry the wipes away from home. For example, U.S. Pat. No. 4,131,195, describes a disposable, compactable moisture-impervious package for dispensing a stack of premoistened sheets. However, the package disclosed therein requires the cutting and adhering of separate pieces of material to form each package.

In addition to requiring the cutting and adhering together of many parts, such as a front face, a rear face, and any adhesive stickers or flaps, which results in additional manufacturing complexity and cost, dispensers may not be durable enough to withstand days or weeks in one's pocket or purse. Further, the closure device, which generally is a resealable opening, may not be durable enough to withstand repeated openings and closings. Failure of the dispenser of the closure device may cause the contents to become dirty and/or fall out of the dispenser and result in a less than satisfactory user experience.

Another problem with portable dispensers is that because of their compact size tissue products may need to be folded multiple times in order to contain several tissues in the small space. However, because of the multiple folds, the user generally must unfold the tissue after dispensing it from the portable pack before being able to use the full-size tissue. This makes it difficult for the user to be able to use the full-size tissue quickly after dispensing it from the portable pack. Moreover, if the tissue needs to be used quickly, before the user has a chance to unfold it, the tissue may not be large enough to offer adequate protection. Another problem which results from the multiple folds is that the user may believe that the tissue is smaller than it actually is.

Accordingly, it would be desirable to provide a portable, flexible sheet material dispenser which is durable enough to be stored in one's bag or purse for long periods of time and which is durable enough to withstand repeated openings and closings. Moreover, it would be desirable to provide a portable, flexible pack sheet dispenser which contains large tissue sheets yet is still small and discreet enough to be placed comfortably and easily into one's bag or purse. In addition, it would be desirable to provide a portable, flexible tissue sheet dispenser where the tissues contained therein are large enough to be suitable for a wide variety of tasks.

SUMMARY OF THE DISCLOSURE

The present invention solves many of the problems of the prior art portable, flexible, sheet dispensers, such as providing a relatively large sheet product in a compact dispenser that may be readily transported and is also durable to withstand prolonged use. For example, the dispenser may include a compact stack of folded tissue products held by the tension of a pair of opposed side panels having a generally elliptical shape. The elliptically shaped side panels result in a rigid, resilient frame-work such that the dispenser has sufficient resiliency to maintain its shape even after a portion of the folded tissue products have been dispensed. Thus, the dispenser may be flexible, such that it is bendable and compressible, but may also have a degree of rigidity to resist deformation when a portion of the folded tissue products have been dispensed.

Accordingly, in one aspect the present invention provides a flexible sheet material dispenser comprising a top panel; a bottom panel; the top and bottom panels at least partially sealed to one another to form top and bottom dispenser edges; a pair of opposed side panels extending between the top and bottom panels; a dispensing opening disposed on the top panel, the opening having a major axis substantially parallel to the top and bottom edges of the dispenser and defining the opening width and a minor axis defining the opening height; and a lid covering the dispensing opening.

In another aspect the invention provides a flexible sheet material dispenser comprising: a top panel; a bottom panel; the top and bottom panels at least partially sealed to one another to form top and bottom dispenser edges; a pair of opposed side panels extending between the top and bottom panels; a dispensing opening disposed on the top panel, the opening having a major axis substantially parallel to the top and bottom edges of the dispenser and defining the opening width and a minor axis defining the opening height, the intersection of the major and minor axis defining an opening midpoint, wherein the opening midpoint is located closer to the bottom edge than the top edge; a ring surrounding the opening and lid attached thereto by a hinge, the hinge being parallel to the bottom edge and disposed closer to the bottom edge than the top edge; and a strap removably attached to the top edge.

In still another aspect the invention provides a flexible sheet material dispenser comprising: a top panel; a bottom panel; the top and bottom panels at least partially sealed to one another to form top and bottom dispenser edges; a pair of opposed side panels extending between the top and bottom panels; a dispensing opening disposed on the top panel, the opening having a major axis substantially parallel to the top and bottom edges of the dispenser and defining the opening width and a minor axis defining the opening height; a lid covering the dispensing opening; a stack of folded tissue sheets disposed in the dispenser, the folded tissue sheets having a first panel, a second panel and a third panel, the first and second panels connect to one another by a first fold line and the second and third panels connected to one another by a second fold line, the first and the third panels folded into facing arrangement with the second panel such that there as a portion of the second panel not contacted by the first or third panels.

DEFINITIONS

Figure 1:
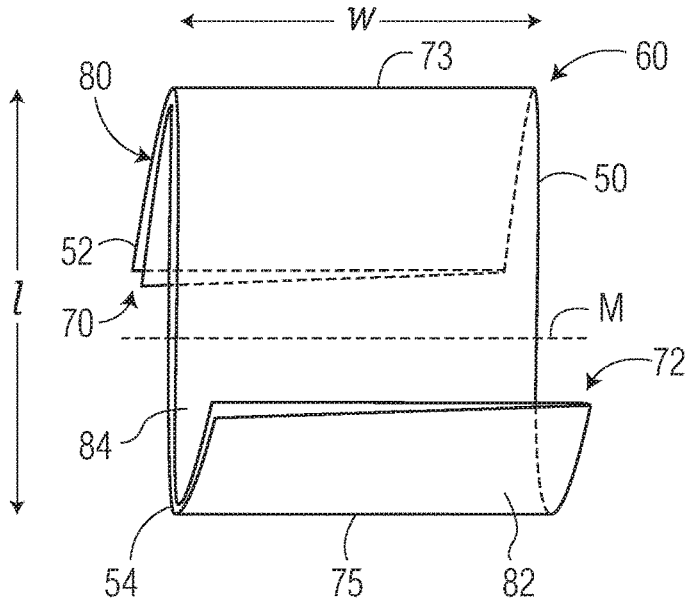
FIG. 1 is a perspective view of a folded tissue sheet useful in the present invention.

As used herein, the term "compact" generally refers to a sheet product that has been folded such that the surface area of the folded product is less than the surface area of the unfolded and more particularly where the ratio of unfolded sheet area to folded sheet area is greater than about 3.0:1. Compact may be used herein to refer to both a compact folded sheet product and a compact stack of folded sheet products. When used to refer to a compact stack of folded sheets area the term generally means the ratio of unfolded sheet area to the top surface area of the stack is greater than about 3.0:1. For example, a compact stack of folded tissue sheets may have a top surface area of about 120 $cm^2$ and the unfolded tissue sheet may have an area of about 450 $cm^2$ providing a ratio of sheet area to the area of the top surface area of the stack of 3.75:1.

As used herein, the term "unfolded sheet area" refers to the area of a single unfolded sheet calculated by multiplying the length of the unfolded sheet by the width of the unfolded sheet. Sheet area is calculated without regard to the number of plies.

As used herein, the term "folded sheet area" refers to the area of a single folded sheet as it is folded and presented to a consumer for use and may be calculated by multiplying the length of the folded sheet by the width of the folded sheet. Folded sheet area is calculated without regard to the number of plies.

As used herein, the term "stack surface area" refers to the area of the top surface of a stack of folded sheets, which may be calculated by multiplying the length of the top surface of the stack by the width of the top surface of the stack.

As used herein, the term "sheet material" refers to a fibrous sheet material suitable for forming a tissue product.

As used herein, the term "tissue product" and "tissue sheet" generally refer to products made from sheet material and includes, bath tissues, facial tissues, paper towels, industrial wipers, foodservice wipers, napkins, medical pads, and other similar products. Tissue products may comprise one, two, three or more plies.

As used herein the term "ply" refers to a discrete product element. Individual plies may be arranged in juxtaposition to each other. The term may refer to a plurality of web-like components such as in a multi-ply facial tissue, bath tissue, paper towel, wipe, or napkin.

DETAILED DESCRIPTION OF THE DISCLOSURE

Generally, the present invention provides a dispenser for dispensing a folded sheet material and more particularly folded tissue sheets arranged in a stack. In one embodiment the invention provides a flexible dispenser having a top and a bottom surface and pair of opposed sidewalls defining a dispenser and a stack of folded sheet material disposed within the cavity. The top surface of the flexible dispenser generally includes an opening through which the sheet material may be removed from the dispenser. In a particularly preferred embodiment the sheet material has been folded in such a manner as to have a starter fold that will efficiently provide tissues to the consumer, with minimal tearing or fallback into the container. Preferably the start fold is aligned with the dispensing opening so that a user may access the starter fold and begin dispensing.

While the instant dispenser is well suited for dispensing a wide variety of sheet material, in a preferred embodiment the dispenser stores and dispenses tissue products. Tissue products useful in the present invention may include dry and wet wiping products and may comprise one or more fibrous webs or plies, where multiple plies are arranged in facing arrangement with one another.

Preferably individual tissue sheets are folded, stacked and disposed within the dispenser for dispensing by a user. The shape of the tissue sheet, when unfolded and laid flat may vary. For example, in one embodiment the tissue sheet, when laid flat, may assume a square or rectangular shape. In a particularly preferred embodiment the unfolded tissue sheet is rectangular having a length dimension, and a width dimension. Exemplary sheet dimensions may be a length from about 20 to about 30 cm and a width from about 20 to about 30 cm. While these are preferred embodiments of sheet dimensions, one skilled in the art will appreciate that the instant dispenser is well suited for dispensing sheets having a wide breadth of dimensions.

Generally individual tissue sheets are folded prior to disposal in the dispenser. Many different folds may be employed, and several embodiments of the invention are shown in the attached Figures. Folds are defined as first folds, second folds, third folds, and the like, by reference to their respective position on the sheet. A fold generally results in a crease or fold line and a pair of panels joined by the crease or fold line. For example, a sheet having three folds generally has four panels and three creases—one crease appearing at the junction of each fold.

In one particularly preferred embodiment, tissue sheets useful in the present dispenser are thrice folded. As illustrated in FIG. 1, the first fold results in a V-folded tissue product having a top 80 and bottom 82 panel with leading edges 52,54 that are aligned. Opposite the leading edges 52,54 is a single folded edge 50. The second fold is completed by folding the top edge 70 along a second fold line 73 towards the bottom edge 72. The third fold is completed by folding the bottom edge 72 along a third fold line 75 towards the top edge 70. In this manner upper 80 and lower 82 panels are created and folded over towards the midpoint (M) of the center panel 84. The upper 80 and lower panels 82 may be folded in the same direction to create a C-folded tissue product or folded in opposite directions to form a Z-folded (as illustrated in FIG. 1) tissue product.

As illustrated in FIG. 1, when the tissue product is Z-folded, the upper panel 80 is brought into facing arrangement with the bottom surface of the center panel 84 and the lower panel 82 is brought into facing arrangement with the top surface of the center panel 84. The fold pattern results in second 73 and third 75 fold lines which are generally parallel to one another as are the top 70 and bottom 72 edges.

In the embodiment illustrated in FIG. 1, the width of the folded product 60 is approximately half of the unfolded sheet and the top 70 and bottom 72 edges (also referred to herein as the first leading edge and the second leading edge) are spaced apart from one another some non-zero distance.

In one embodiment, the first 70 and the second 72 leading edges are folded towards the midpoint (M). In one embodiment the first and the second leading edges 70, 72 may be equally spaced apart from the midpoint (M) and the top 80 and bottom 82 panels may have the same width and substantially similar lengths. One skilled in the art however, will appreciate that the invention is not so limited and that the relative length of the top and bottom panel may vary. For example, in one embodiment the length of the top panel may be greater than the length of the bottom panel. In other embodiments the length of the bottom panel may be greater than the length of the top panel.

Figure 2:
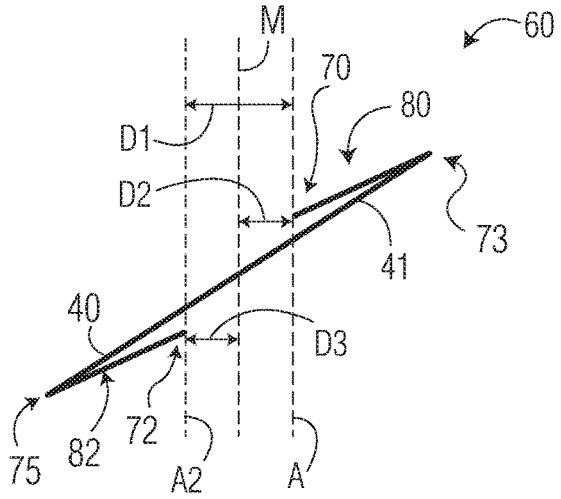
FIG. 2 is a perspective view of a folded tissue sheet useful in the present invention.

Regardless of the relative lengths of the top and bottom panels, in one embodiment, such as illustrated in FIG. 2, the edges 70, 72 are folded towards the midpoint (M) and terminate at a first and second axis A, A2. In this manner the first edge 70 spaced away from the midpoint (M) a distance D2 and the second edge 72 spaced away a distance D3 and the first 70 and second 72 edges are spaced apart from one another some non-zero distance D1. Spacing the first 70 and second 72 edges apart from one another in this manner results in a product 60 generally having fewer panels at the midpoint (M) than either of the first or second ends.

While the embodiment of FIG. 2 illustrates neither the first 70 nor the second 72 edge crossing the midpoint (M), the invention is not so limited. In other embodiments the first and the second edges may be folded towards the midpoint of the tissue sheet with one of the ends crossing the midpoint. In such embodiments, however, there is generally some portion of the tissue product 60 between the first 70 and second 72 edges that has fewer panels than either of the first or second ends.

The folded sheet products may be stacked to provide a stack of folded sheet product for packaging and dispensing to a user. In a particularly preferred embodiment, the sheets are not interfolded with one another, but rather are stacked one upon the other. For example, a plurality of tissue sheets may each be folded by first forming a V-folded tissue product and then forming a Z- or C-folded tissue product, as described above, and then the folded tissue sheets may be stacked one upon the other.

Preferably the sheet material is folded such that the folded sheet product is compact. For example, the sheet product may be folded such that the surface area of the folded product is less than the surface area of the unfolded product and more particularly where the ratio of unfolded sheet area to folded sheet area is greater than about 3.0:1. Compact folded sheets may be stacked together to yield a compact stack of folded sheet material where the ratio of unfolded sheet area to the top surface area of the stack is greater than about 3.0:1, and more preferably greater than about 3.5:1 and still and more preferably about 3.75:1 or greater. For example, in one embodiment, a compact stack of folded tissue sheets may have a top surface area of about 120 $cm^2$ and the unfolded tissue sheet may have an area of about 450 $cm^2$ and the folded sheets may be stacked upon each other to provide a stack with a top surface area of about 120 $cm^2$ and a ratio of sheet area to stack area of about 3.75:1. Below is a comparison of compact stacks of tissue useful in the present invention compared to other commercially available stacks of tissues.

TABLE 1

| Product | Fold Pattern | Sheet Area ($cm^2$) | Stack Area ($cm^2$) | Ratio Sheet Area: Stack Area |
|---|---|---|---|---|
| KLEENEX ® Fresh On The Go ® wipes | Z-Fold/V-Fold | 300 | 75 | 4:1 |
| HUGGIES ® wipes soft pack | Z-Fold | 327.6 | 163.8 | 2:1 |
| HUGGIES ® Clutch 'N' Clean ® wipes | Z-Fold | 327.6 | 163.8 | 2:1 |
| COTTONELLE ® flushable cleansing clothes soft pack | V-Fold | 231 | 136.8 | 1.68:1 |
| HUGGIES ® hands and face | Z-Fold/V-Fold/C-Fold | 360 | 72 | 5:1 |
| PUFFS ® soft pack basic | V-Fold | 443 | 221.5 | 2:1 |
| Inventive | V-Fold/S-Fold | 445.2 | 119.84 | 3.7:1 |

Preferably the stack of sheet material is disposed in a flexible package for storage and dispensing to a user. In a particularly preferred embodiment the flexible package comprises a top panel, an opposing bottom panel and pair of side panels. The side panels are bonded to the top and bottom panels so as to provide the flexible package with a degree of resiliency. In a particularly preferred embodiment the shape of the side panels may be further optimized to provide the package with sufficient resiliency to maintain its shape even after a portion of the tissue sheets have been dispensed. For example, the side panels may be generally elliptically shaped and bonded to the top and bottom panels such that the package retains its shape after a portion of the sheet have been dispensed.

The foregoing embodiment in which the side panels are elliptically shaped and bonded to the top and bottom panels results in a rigid, resilient frame-work and has the additional benefit of forming a laminated, elliptical leaf spring. The stack of sheet material disposed within the package may be held by the tension in the leaf spring and the seams resulting from the bonding of the side panel to the top and bottom panels.

Figure 3:
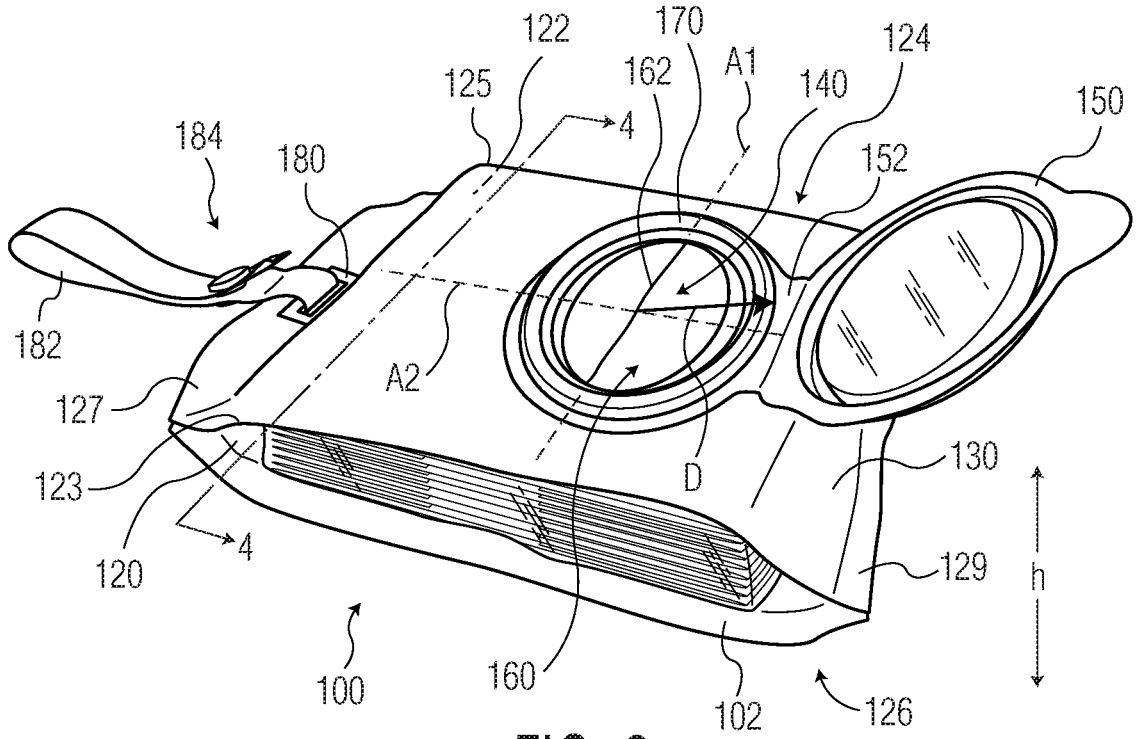
FIG. 3 is a perspective view of a dispenser according to one embodiment of the present invention.

With reference now to FIG. 3, one embodiment of a dispenser 100 useful in the present invention is illustrated. The dispenser 100 comprises a flexible pouch 130 that has a top 124 and a bottom 126 spaced apart from each other in the height dimension (h) and joined by a pair of opposing side panels 120, 122. The top 124 is joined to the side panels 120, 122 along a pair of side edges 123, 125 and further has opposed top 127 and bottom 129 edges. When joined the top 124, bottom 126 and side panels 120, 122 define an interior space which may receive a stack of folded sheet products.

The dispenser 100 further includes a dispensing opening 140 formed in the top panel 124. The dispensing opening 140 can be a hole, a slit, or other opening through which a sheet 160 can suitably be dispensed. In a particularly preferred embodiment the sheet 160 has first edge 162 that is visible to a user in the dispensing opening 140. The user may dispense the sheet 160 by grasping the edge 162 and dispensing in a direction (D) indicated by the arrow towards the bottom edge 129 of the dispenser 100.

The dispenser 100 in particular embodiments further includes a movable lid 150 adapted to cover the dispensing opening 140 to help protect the folded sheet products 160. In particular embodiments, the dispensing opening 140 is surrounded by a rigid ring 170, and the lid 150 is hingedly attached to the ring 170 via a hinge 152. In a particularly preferred embodiment the lid 150 may include a tab for grasping and operating the lid. The tab may be preferably disposed opposite of the hinge such that a user may grasp the tab to open the lid by applying a downward force towards the bottom edge 129 of the dispenser 100.

In particular embodiments, the top 124, bottom 126 and side 120, 122 panels are each formed from a flexible material having a bending resistance of between 21.0 and about 300 milligrams of force. As used herein, "bending resistance" means the bending resistance as measured in accordance with the protocol outlined below. In particular embodiments, the flexible material has a bending resistance of between 21.0 and 150 milligrams of force, more particularly between about 40 and 150 milligrams of force, more particularly between about 40 and 125 milligrams of force, more particularly between about 40 and 100 milligrams of force, more particularly between about 60 and about 100 milligrams of force, and more particularly between about 60 and about 90 milligrams of force. It has been discovered that by constructing the top 124, bottom 126 and side 120, 122 panels of such materials, the pouch 130 is durable, is perceived as being high in quality, is efficiently processable, is reasonable in cost, in particular embodiments exhibits minimal "crinkling" noise as it is manipulated, and is flexible enough to bend to fit into a purse, diaper bag, or similar container.

In particular embodiments, the top 124, bottom 126 and side 120, 122 panels are each formed from a flexible material that has a thickness of at least 1.5 mils, more particularly at least about 5 mils, and still more particularly between about 2 to about 3 mils.

In one particularly preferred embodiment the flexible package 100 is formed by bonding the various panels together along their periphery. For example, in one embodiment, the top panel 124 is bonded to the side panels 120, 122 by heat sealing the opposed lateral side edges of the top panel 124 to the surface of side panels 120, 122 at the desired peripheral surface thereof. The application of a sufficient amount of heat and pressure to the lateral edges of the top panel 124 may bond the peripheral surface of the side panels 120, 122. A similar process may be used to bond the bottom panel 126 to the side panels 120, 122.

Similarly the top panel 124 may be bonded to the bottom panel 126. Preferably in those instances where the top and bottom panels 124, 126 are bonded to one another they are bonded to one another along their respective top and bottom edges to form the top 127 and bottom 129 edges of the package 100. For example, in one embodiment, the top panel 124 is bonded to the bottom panel 126 by heat sealing the opposed top and bottom edges of the top panel 124 to the surface of bottom panel 126 at the desired peripheral surface thereof. The application of a sufficient amount of heat and pressure to the opposed top and bottom edges of the top panel 124 may bond the peripheral surface of the bottom panel 126 to form the top 127 and bottom 129 edges.

Thus, in certain embodiments, the dispenser 100 has a peripheral bonded edge 102 which consists of the pair of side edges 123, 125 and opposed top 127 and bottom 129 edges. The peripheral bonded edge may be continuously or intermittently bonded. In a particularly preferred embodiment the peripheral bonded edge is continuously and permanently bonded.

While the foregoing bond is preferably formed by heat sealing, the invention is not so limited. Should heat sealing provide impracticable or uneconomical for certain package materials other bonding methods well known in the art may be employed. For example, an adhesive, such as a urethane or an epoxy adhesive may be employed to bond the various panels to one another.

In certain embodiments one of the seal edges may be provided with a strap, loop, hoop or the like for transporting, grasping, hanging or storing the dispenser. In a particularly preferred embodiment, convenient, one-handed dispensing is provided by attaching the package opposite the dispensing opening to purses, back packs, bags, in the car, etc. with a strap. The strap may be wrapped around a secure object and reattached to itself or the package with a snap, hook, toggle and hole, carabineer, to securely attach the dispenser to the object. For example, as illustrated in FIG. 3, a strap 182 may be threaded through an opening 180 disposed on the top edge 127 to attach the strap thereto. The strap 182 may be provided with a releasable fastener 184 for removably attaching the dispenser to objects.

In those embodiments where the dispenser is provided with a strap 182, the strap 182 may be used to anchor the dispenser 100 and facilitate one-handed use by a user. For example, the strap 182 may be affixed to an object to anchor the dispenser 100 and the user may use a single hand to open the lid 150 by applying a force in a direction opposite the strap 182. When the lid 150 is opened the sheet 160 is revealed along with edge 162 for dispensing. The edge 162 may be orientated perpendicular to the strap 182 such that a user may grasp the edge 162 and apply a force that is generally in the direction away from the strap 182 towards the bottom edge 129 to dispense the tissue 160.

Figure 4:
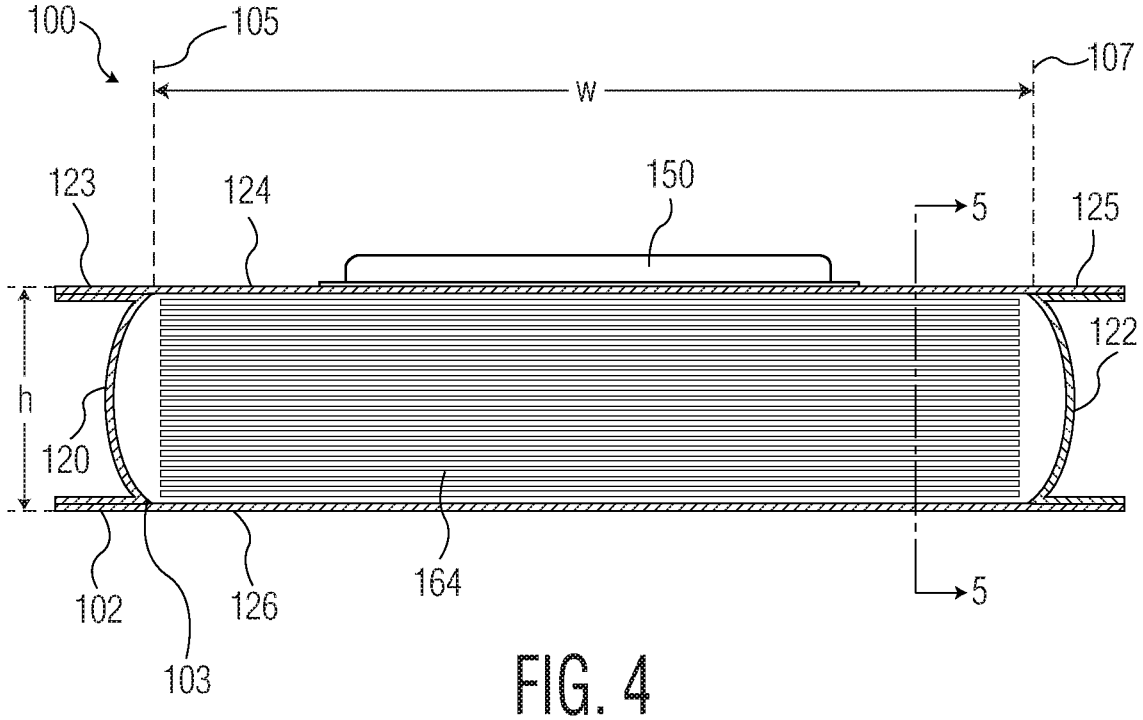
FIG. 4 is a cross-section view of the dispenser of FIG. 3 through line 4-4.

Turning now to FIG. 4, a cross-section of the dispenser 100 containing a stack of folded sheet product 164 is illustrated. The dispenser 100 comprises a pair of opposed side panels 120, 122 which are bonded to the top 124 and bottom 126 panels along their peripheral edges to form a bonded peripheral edge 102. As illustrated, the bonded peripheral edge 102 generally comprises two different panels brought into facing relation with one another and bonded together to form an edge. The width (w) of the package 100 is generally measured as the distance between a pair of imaginary lines 105, 107 extend from the inner edge 103 of the bonded peripheral edge 102.

In certain embodiments the top and/or bottom edges may be formed at least partially by bonding the side panel to the top and bottom panel. For example, a peripheral portion of the top and bottom panels may be bonded to one surface of the side panel along its peripheral edge. The opposing surface of the side panel may then be folded over and brought into facing arrangement with itself and bonded. In this manner the top and/or bottom edge may comprise four layers of material.

Figure 5:
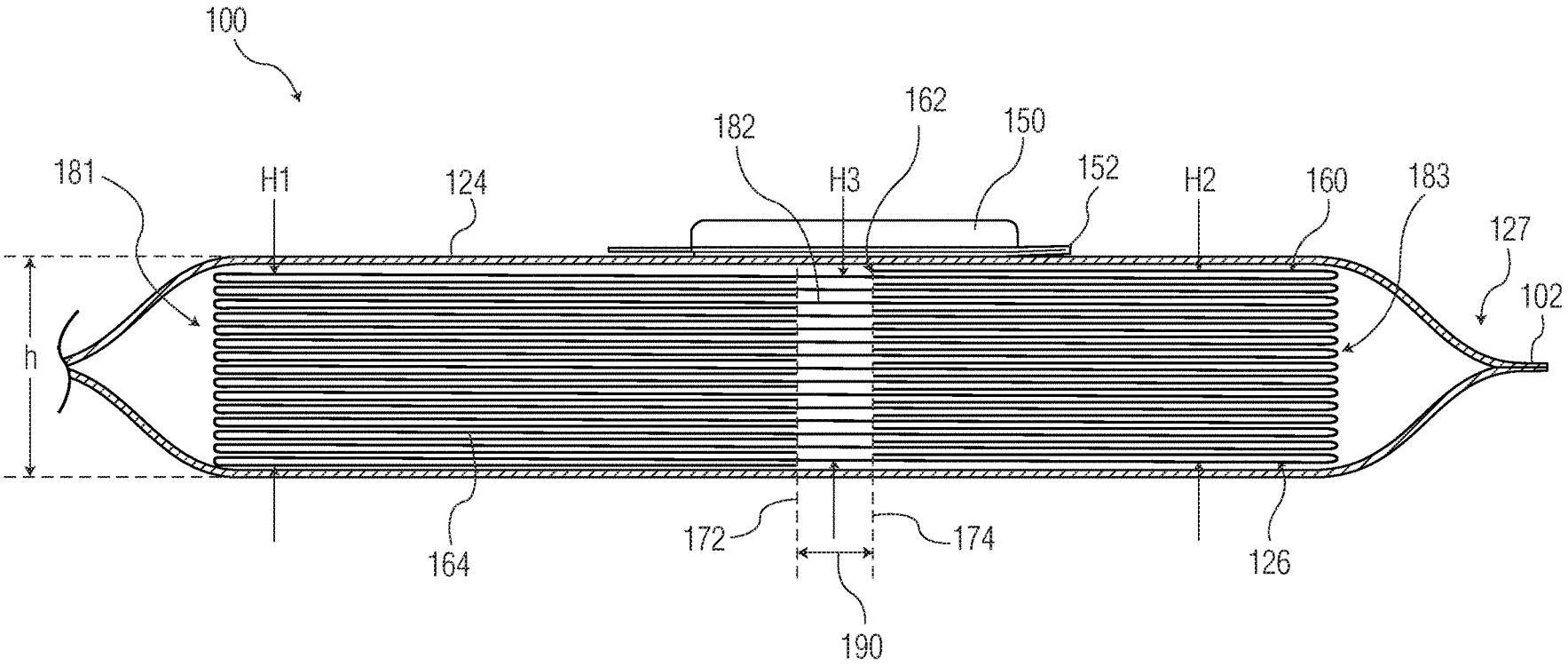
FIG. 5 is a cross-section view of the dispenser of FIG. 5 through line 5-5.

With reference to FIG. 5, one preferred embodiment of a stack of tissues 164 disposed within the dispenser 100 is illustrated. As described previously it may be preferable to fold the sheets such that the edges 172, 174 are folded towards the midpoint of the sheet and spaced apart from one another some non-zero distance 190. Further, it may be desirable to position the leading edge 162 of the upper most sheet 160 in the stack 164 such that it would be visible to a user through the dispenser opening. While not wishing to be bound by theory, it is believe that folding the sheets in this manner improves dispensing and provides a stack 164 with first and second folded ends 181, 183 comprising the same number of sheets and having a first and a second height H1, H2 that are substantially similar. By folding the sheets such that there is an edge gap 190, however, the middle portion 176 of the stack comprises a different number of sheets than the first and second folded ends 181, 183 and having a height H3 that is less than H1 and H2. In this manner the stack of folded tissues may be said to have a narrower waist, generally defined by the middle portion 182 of the stack.

Thus, in one particularly preferred embodiment, the invention provides a stack of tissues having a first end having a first height H1, generally measured about 1 cm from the first end of the tissue stack, a second end having a second height H2, generally measured about 1 cm from the second end of the tissue stack opposite of the first end, and a middle having a third height H3, generally measured at the midpoint of the tissue stack, where H1 and H2 are substantially equal and where H3 is about 10 percent less than H1 and H2, such as from about 10 to about 50 percent less.

Figure 6:
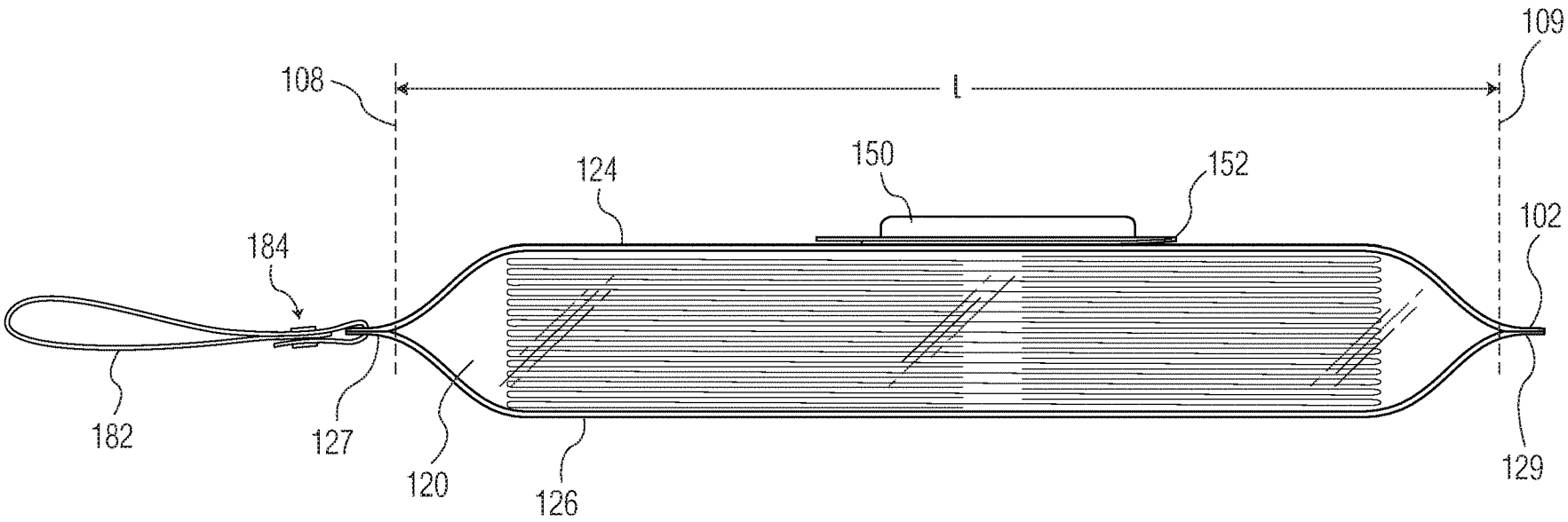
FIG. 6 is a side-view of a dispenser according to one embodiment of the present invention.

With reference now to FIG. 6, one preferred embodiment of the present invention is illustrated showing one possible configuration of a hinged 152 lid 150 relative to a retention strap 182. The hinge 152 may be positioned towards the bottom edge 129 such that the lid 150 is opened towards the bottom edge 129. In this manner the lid 150 is opened away from the top edge 127 to which the retention strap 182 may be attached. It may be further preferred to position the lid 150 on the top surface 124 such that it is closer to the bottom edge 129 than the top edge 127. In those embodiments where the lid 150 is biased towards the bottom edge 129, the lid 150 will generally not be centered along the length (I) of the dispenser 100, which is generally measured between vertical axis 108, 109.

Figure 7:
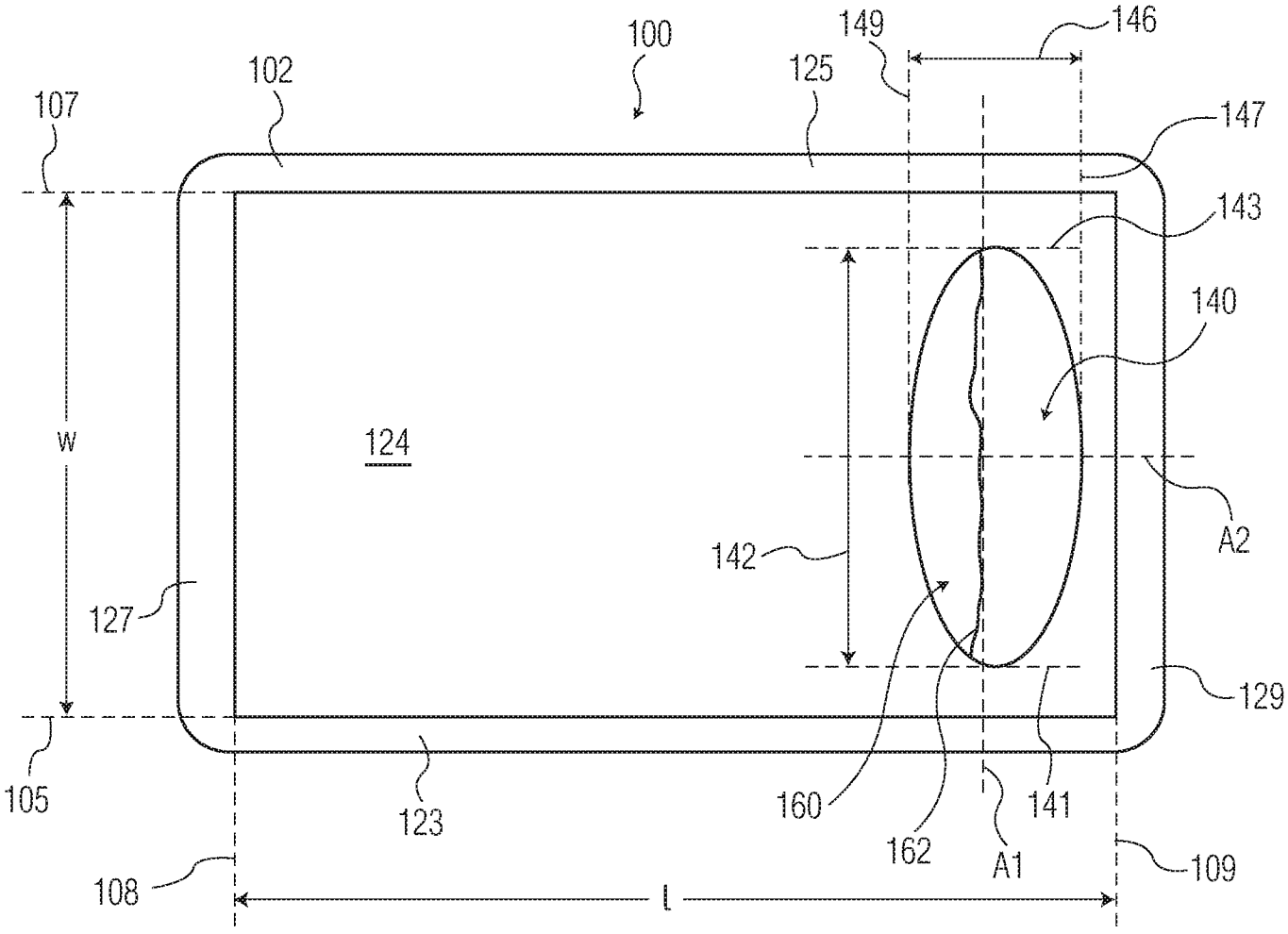
FIG. 7 is a top plane view of a dispenser according to one embodiment of the present invention.

With reference now to FIG. 7, the spacing and arrangement of the dispensing opening 140 on the top panel 124 of the dispenser 100 is further illustrated. In particular embodiments, the dispensing opening 140 has two principle axis: a major axis A1 orientated horizontally and a minor axis A2 orientated vertically. The major axis A1 extends in the length width (w) and defines a dispensing opening width. As representatively illustrated in FIG. 3, the dispensing opening width 142 is defined as the distance in the width dimension between a first imaginary line 141 that passes through the point of the dispensing opening 140 that is closest to the first side edge 123 and the second imaginary line 143 that passes through the point of the dispensing opening 140 that is closest to the second side edge 125. The dispensing opening 140 similarly has a length 146, which is defined as the distance in the length (I) dimension between a first imaginary line 147 that passes through the point of the dispensing opening 140 that is closest to the bottom edge 129 and the second imaginary line 149 that passes through the point of the dispensing opening 140 that is closest to the top edge 127.

In a further preferred embodiment, the leading edge of the sheet to be dispensed is orientated along the width dimension of the sheet as well as the width dimension of the dispenser opening. The orientation of the leading edge generally parallel to both the width of the sheet and the width of the dispenser opening is unlike conventional dispensers of folded sheet material where the sheet is customarily folded along its length to present a leading edge orientated along the sheet length which in-turn is aligned with the length. Folding and orientating the sheet according to the present embodiment facilitates one-handed dispensing of the sheet by the user and more particularly one-handed dispensing when the sheet is initially dispensed in a direction towards the bottom edge of the dispenser and towards the hinge. This type of dispensing may be further facilitated by providing a strap at the top edge of the dispenser and aligning the strap substantially at the midpoint of the dispenser's width and perpendicular to the width dimension of the sheet.

In other embodiments, it may be desirable to provide a folded sheet product having a leading edge that is perpendicular to both the length axis of the sheet and to the orientation of the first fold line. In this manner the dispenser may be provide for dispensing a direction that is perpendicular to the orientation of the first fold line.

In addition to optimizing the sheet fold pattern to accommodate dispensing from the flexible dispenser of the present invention, the shape, size and location of the dispensing opening may also be optimized. For example, the dispenser of the present invention may have an opening that is off-center unlike conventional sheet dispensers which have an opening centered over the interior space of the dispenser in both length and width directions. Accordingly, in one particularly preferred embodiment the invention provides a dispenser having a top panel with a bottom and a top edge and an opening having a major axis and a minor axis, the intersection of which define an opening mid-point, disposed thereon, where the opening mid-point is positioned closer to either the top or the bottom edge.

Accordingly, in particular embodiments, the midpoint (generally defined as the intersection of the major A1 and minor A2 axis) of the dispensing opening 140 is disposed closer to the bottom edge 129 than to the top edge 127. In particular embodiments, the midpoint of the dispensing opening 140 is disposed at least 5 millimeters closer, more particularly at least 10 millimeters closer, and still more particularly at least 15 millimeters closer the bottom edge 129 than to the top edge 127.

In a particularly preferred embodiment the top panel may be divided into two equal length-wise halves where the opening is located entirely in only one half. For example, the invention provides a dispenser having a top panel with a length of about 20 cm and width of about 14 cm, which can be divided into a first and a second half, where each half has a length of about 10 cm and width of about 14 cm where the opening is disposed entirely in the first half.

In still other embodiments, in addition to optimizing the location the dispensing opening, the size of the opening may be optimized. For example, in one embodiment the invention provides a dispenser having a large carton opening relative to the top panel of the dispenser. Thus, in one embodiment, the area of the opening 140 preferably comprises at least about 50 percent of the total area of the top panel 124. In a particularly preferred embodiment the area of the opening comprises from about 50 to about 85 percent and still more preferably from about 55 to about 70 percent of the total area of the top panel. Accordingly, with reference to FIG. 7, in certain preferred embodiments the opening 140 is oval and has a length 142 and a width 146 and the top panel 124 is substantially rectangular having a width (w) and a length (I) where the opening has a width from about 6.0 to about 9.0 cm and a length from about 3.0 to about 4.0 mm.

While in certain embodiments the area of the opening may be large relative to the area of the top panel, the area of the opening may be modestly sized relative to the sheet to be dispensed. Thus, in certain embodiments the opening area may range from about 10 to about 30 $cm^2$, such as from about 15 to about 25 $cm^2$, while the sheet to be dispensed may have an area from about 450 $cm^2$ providing a ratio of sheet area to the area of the top surface area of the stack of 3.75:1.

What is claimed is:

1. A flexible sheet material dispenser comprising:

a. a top panel;

b. a bottom panel; the top and bottom panels at least partially sealed to one another to form top and bottom edges;

c. a pair of opposed side panels extending between the top and bottom panels;

d. a dispensing opening disposed on the top panel, the opening having a major axis substantially parallel to the top and bottom edges and defining the opening width and a minor axis defining the opening height, the intersection of the major and minor axis defining an opening midpoint, wherein the opening midpoint is located between the top and bottom edges;

e. a stack of folded tissue sheets having an unfolded sheet area disposed in the dispenser, the folded tissue sheets having a first panel, a second panel, and a third panel, a fourth panel and a fifth panel, the first and second panels connected to one another by a first fold line, and the second and third panels connected to one another by a second fold line, and the fourth and fifth panels connected to one another by a third fold line, wherein the third fold line is perpendicular to the first and second fold lines, the first panel having a first edge terminating at a first vertical axis and the third panel having a second edge terminating at a second vertical axis, wherein the first edge is substantially parallel to the opening's major axis and wherein the ratio of the unfolded sheet area to the top surface area of the stack is greater than about 3.0:1; and f. a lid covering the dispensing opening.

2. The flexible sheet material dispenser of claim 1 wherein the distance between the first and the second vertical axis is greater than zero.

3. The flexible sheet material dispenser of claim 1 wherein the folded tissue sheets have a width dimension and a length dimension and wherein the distance between the first and the second vertical axis is from about 0.5 to about 30 percent of the length dimension.

4. The flexible sheet material dispenser of claim 1 wherein the ratio of the unfolded sheet area to the top surface area of the stack is greater than about 3.5:1.

5. The flexible sheet material dispenser of claim 1 further comprising a ring surrounding the dispensing opening and a hinge connecting the ring and the lid, wherein the hinge is substantially parallel to the top and bottom edges.

6. The flexible sheet material dispenser of claim 1 further comprising a strap attached to the top edge.

7. The flexible sheet material dispenser of claim 6 wherein the strap is removably attached to the top edge.

8. The flexible sheet material dispenser of claim 6 wherein the top edge has a width and the strap is attached substantially at the midpoint of the top edge's width.

9. A flexible sheet material dispenser comprising:

a. a top panel;

b. a bottom panel; the top and bottom panels at least partially sealed to one another to form top and bottom edges;

c. a pair of opposed side panels extending between the top and bottom panels;

d. a dispensing opening disposed on the top panel, the opening having a major axis substantially parallel to the top and bottom edges and defining the opening width and a minor axis defining the opening height, the intersection of the major and minor axis defining an opening midpoint, wherein the opening midpoint is located closer to the bottom edge than the top edge;

e. a ring surrounding the opening and lid attached thereto by a hinge, the hinge being parallel to the bottom edge and disposed closer to the bottom edge than the top edge;

f. a stack of folded tissue sheets having an unfolded sheet area disposed in the dispenser, the folded tissue sheets having a first panel, a second panel, and a third panel, a fourth panel and a fifth panel, the first and second panels connected to one another by a first fold line, and the second and third panels connected to one another by a second fold line, and the fourth and fifth panels connected to one another by a third fold line, wherein the third fold line is perpendicular to the first and second fold lines, the first panel having a first edge terminating at a first vertical axis and the third panel having a second edge terminating at a second vertical axis, wherein the first edge is substantially parallel to the opening's major axis and wherein the ratio of the unfolded sheet area to the top surface area of the stack is greater than about 3.0:1; and g. a strap attached to the top edge.

10. The flexible sheet material dispenser of claim 9 wherein the dispenser top edge has a width and the strap is attached substantially at the midpoint of the top edge's width.

11. The flexible sheet material dispenser of claim 9 wherein the folded tissue sheets have a width dimension and a length dimension and wherein the distance between the first and the second vertical axis is from about 0.5 to about 30 percent of the length dimension.

12. The flexible sheet material dispenser of claim 9 wherein the ratio of the unfolded sheet area to the top surface area of the stack is greater than about 3.5:1.

13. A flexible sheet material dispenser comprising:

a. a top panel;

b. a bottom panel; the top and bottom panels at least partially sealed to one another to form top and bottom edges;

c. a pair of opposed side panels extending between the top and bottom panels;

d. a dispensing opening disposed on the top panel, the opening having a major axis substantially parallel to the top and bottom edges and defining the opening width and a minor axis defining the opening height;

e. a lid covering the dispensing opening;

f. a stack of folded tissue sheets having an unfolded sheet area disposed in the dispenser, the folded tissue sheets having a first panel, a second panel, and a third panel, a fourth panel and a fifth panel, the first and second panels connected to one another by a first fold line, and the second and third panels connected to one another by a second fold line, and the fourth and fifth panels connected to one another by a third fold line, wherein the third fold line is perpendicular to the first and second fold lines, the first and the third panels folded into facing arrangement with the second panel such that there is a portion of the second panel not contacted by the first or third panels wherein the first panel has a first edge terminating at a first vertical axis and the third panel has a second edge terminating at a second vertical axis and wherein the first edge is substantially parallel to the opening's major axis and wherein the ratio of the unfolded sheet area to the top surface area of the stack is greater than about 3.0:1.

14. The flexible sheet material dispenser of claim 13 wherein the intersection of the opening's major and minor axis defines an opening midpoint and wherein the opening midpoint is located closer to the bottom edge than the top edge.

15. The flexible sheet material dispenser of claim 13 wherein the ratio of the unfolded sheet area to the top surface area of the stack is greater than about 3.5:1.

16. The flexible sheet material dispenser of claim 13 wherein the stack of folded tissue sheets has a midpoint disposed between the first and second edges the first and second edges are equally spaced apart from the midpoint.

17. The flexible sheet material dispenser of claim 13 wherein the stack of folded tissue sheets have a first end having a first height (H1) and a second end having a second height (H2) wherein H1 and H2 are substantially similar.

18. The flexible sheet material dispenser of claim 13 wherein the first edge of an uppermost folded sheet is visible to a user through the dispensing opening.

* * * * *